US010299581B2

(12) United States Patent
Keller et al.

(10) Patent No.: US 10,299,581 B2
(45) Date of Patent: May 28, 2019

(54) FURNITURE COMPOSITION WITH HEIGHT-ADJUSTABLE PARTITION

(71) Applicant: Vitra Patente AG, Birsfelden (CH)

(72) Inventors: Stefan Keller, Steinen-Hofen (DE); Helmut Schütt, Müllheim-Hügelheim (DE)

(73) Assignee: VITRA PATENTE AG, Birsfelden (CH)

( * ) Notice: Subject to any disclaimer, the term of this patent is extended or adjusted under 35 U.S.C. 154(b) by 0 days.

(21) Appl. No.: 15/695,612

(22) Filed: Sep. 5, 2017

(65) Prior Publication Data

US 2018/0064243 A1 Mar. 8, 2018

(30) Foreign Application Priority Data

Sep. 6, 2016 (EP) ..... 16187436

(51) Int. Cl.
*A47B 21/02* (2006.01)
*A47B 9/08* (2006.01)
*A47B 13/08* (2006.01)

(52) U.S. Cl.
CPC ..... *A47B 21/02* (2013.01); *A47B 9/08* (2013.01); *A47B 13/088* (2013.01); *A47B 2200/0046* (2013.01); *A47B 2200/0085* (2013.01); *A47B 2200/12* (2013.01)

(58) Field of Classification Search
CPC ..... A47B 21/02; A47B 13/088; A47B 2200/0046; A47B 2200/0085; A47B 2200/12; A47B 57/00; A47F 5/005; A47G 5/02
USPC ..... 108/60, 61; 211/186
See application file for complete search history.

(56) References Cited

U.S. PATENT DOCUMENTS 516,018 A * 3/1894 Lauer ..... B60J 1/205 160/262
740,920 A * 10/1903 Rees et al. ..... E04F 10/10 160/262
1,992,903 A * 2/1935 Potashnik ..... A47B 83/02 108/161

(Continued)

FOREIGN PATENT DOCUMENTS

| | | |
|---|---|---|
| DE | 19900506 | 7/1999 |
| DE | 102006034322 | 1/2008 |
| JP | 2005118258 | 5/2005 |

OTHER PUBLICATIONS

European Search Report issued in EP Application No. 16 18 7436, dated Feb. 7, 2017.

*Primary Examiner* — Jose V Chen
(74) *Attorney, Agent, or Firm* — Medler Ferro Woodhouse & Mills PLLC

(57) ABSTRACT

A furniture composition comprises a first workstation having a first worktop adjustable in a vertical direction, a second workstation having a second worktop adjustable, independently of the first worktop, in the vertical direction, and a height-adjustable partition which extends in the vertical direction between the first and second workstation. A first support element is provided on the first worktop, by means of which the partition can be supported in the vertical direction, and a second support element on a second worktop, by means of which the partition can be supported in the vertical direction.

18 Claims, 5 Drawing Sheets

(56) References Cited

U.S. PATENT DOCUMENTS 2,821,450 A * 1/1958 Knoll ..... A47B 83/001 108/60
2,944,861 A * 7/1960 Lessin ..... A47B 17/02 108/60
3,083,417 A * 4/1963 Cook ..... A47B 41/00 108/60
3,117,534 A * 1/1964 Martland ..... A47B 41/00 108/161
4,553,359 A * 11/1985 Potter ..... A47F 10/06 108/60
5,067,546 A * 11/1991 Jeuffray ..... B60J 1/2044 160/23.1
5,323,695 A * 6/1994 Borgman ..... A47B 9/00 108/147
5,743,193 A * 4/1998 Kakuta ..... A47B 21/02 108/106
6,062,147 A * 5/2000 Footitt ..... A47B 17/00 108/50.01
7,789,025 B2 * 9/2010 Michaud, II ..... A47B 17/02 108/147
8,359,809 B1 * 1/2013 Erickson ..... E04B 2/7422 52/239
8,960,102 B2 * 2/2015 Rheault ..... A47B 13/10 108/50.01
9,883,737 B2 * 2/2018 Lanphear ..... A47B 13/088
2004/0140066 A1 * 7/2004 Brennan ..... A47B 97/00 160/351
2011/0239908 A1 * 10/2011 Nakamura ..... A47B 17/00 108/50.11
2012/0304900 A1 * 12/2012 Henriott ..... A47B 13/06 108/91
2013/0239856 A1 * 9/2013 Lee ..... G09F 23/08 108/50.17
2014/0158024 A1 6/2014 Henriott
2014/0238277 A1 * 8/2014 Fishman ..... A47B 37/00 108/25
2014/0312754 A1 * 10/2014 Hecht ..... A47B 9/04 312/309
2014/0318423 A1 * 10/2014 Parshad ..... A47B 83/001 108/60
2017/0006367 A1 * 1/2017 Domash ..... H04R 1/026
2018/0064244 A1 * 3/2018 Tsai ..... A47B 9/20

* cited by examiner

FURNITURE COMPOSITION WITH HEIGHT-ADJUSTABLE PARTITION

TECHNICAL FIELD

The invention relates to a furniture composition and to a partition for a furniture composition. The invention can be used in particular in the field of office, laboratory and workshop furniture, in particular as a desk composition.

PRIOR ART

Height-adjustable workstations, in particular desks, have been known for a long time. Through the possibility to adjust the height of a worktop of the workstation, i.e. to adjust the worktop in the vertical direction, the workstation can be optimally adapted to the body size of a person working at same, which can be an important precondition for an ergonomic and particularly spine-friendly and back-friendly working posture.

Previously, height-adjustability was often only possible over a relatively limited range, in order to compensate for large differences within the range of the statistically relatively low standard deviation in body sizes of seated adult persons. Today however, workstations, in particular desks, that have increased height-adjustability making it possible if required to work standing up, are very popular. Since longer periods of work standing up can be uncomfortable and/or tiring, it is important to have the possibility for quick and trouble-free adjustability between workstation heights that are suitable for working standing up and those that are suitable for working when seated. In particular, it should be easily possible to make frequent adjustments to the vertical position.

In parallel to this, in order among other things to make optimum use of office space and/or to make use of synergies, workstations are often arranged in groups. Such table compositions can provide two workstations arranged opposite one another, side-by-side or adjoining at a corner. The respective workstations can be arranged with the short side or a long side of each being adjacent, or a first worktop can have a short side adjacent to a long side of a second worktop. For such workstations arranged in groups, it can be important, for the above stated reasons, to have the possibility to adjust the height of the individual workstations separately.

It is also known to provide partitions between the workstations in order to allow undisturbed and concentrated work at table compositions or workstation composition. Such partitions can among, other things, serve as privacy screens or acoustic screens. They can also help to separate the workstations from one another and prevent objects falling from one workstation onto the other, or falling between the two.

For table compositions with individually height-adjustable worktops or tabletops, the problem arises that the partition is not adapted to the respective height setting of adjacent workstations. For example, it is often the case that relatively large partitions or separating walls are provided between the worktops, which shield the workstations from one another at each height setting of the neighbouring worktops. In particular, a fixed separating wall is typically provided extending in the vertical direction, which is mounted for example on a support frame or on one or both worktops, in particular a table frame, or is placed on the floor. In order for such a partition to be effective over the entire range of the height-adjustability of the workstations, the partition must extend in the vertical direction at least to a height that is suitable for a maximum height of the worktops. Thus, when the worktops are positioned in the low height setting region, the partition projects far above these in the vertical direction. This can prevent cooperative work that extends beyond one workstation when required, and may also feel somewhat claustrophobic or disruptive and be visually unappealing.

Alternatively, it is known to provide each of the individual worktops with partitions which, when a height adjustment takes place, must be height-adjusted together with the workstation. Such partitions can feel more comfortable than the above described separation walls, but typically however do not provide an adequate effect or shielding at each height setting of two adjacent worktops. For example, for such partitions it is often not possible to prevent the area under the worktops from being visible in the event that the worktops are at very different heights.

An object of the invention is to providing a furniture composition which is simply constructed, is flexible with regard to height-adjustable worktops and enables suitably adapted partition of workstations.

DISCLOSURE OF THE INVENTION

These and further problems are solved by a furniture composition as described below and by a partition for a furniture composition as described below.

In one aspect, the invention proposes a furniture composition, in particular a multi-person workstation, for example a desk composition. The furniture composition comprises a first workstation having a first worktop that is adjustable in a vertical direction, a second workstation having a second worktop that is adjustable in the vertical direction independently from the first worktop, and a partition that is height-adjustable or, if appropriate, adjustable in the vertical direction, which is arranged extending in the vertical direction, between the first and the second workstation. At least one support element is provided at the first worktop, by means of which the partition can typically be supported in the vertical direction. A second support element is provided at the second worktop, by means of which the partition can be supported typically in the vertical direction.

The term "vertical direction" can refer here, in particular, to a perpendicular direction i.e. a downward or upward direction. Deviations from an exactly perpendicular alignment of the direction can likewise be included. The vertical direction can thus lie approximately perpendicular.

The term "worktop" in the context of the invention can relate to a plate-shaped element, on which an activity is carried out. In particular, the worktop may be a tabletop. In many applications such worktops have a horizontal surface. The worktops can however also be arranged tilted or inclined.

The furniture composition can also comprise more than two workstations, respectively having further worktops. Accordingly, further support elements and partitions can be provided, which separate these further workstations.

The support elements can have any desired shape that allows them to support the partition in certain situations and to be detached from the partition in other situations. The support elements can be multi-piece, in order for example to achieve a uniform support of the partition. In this context, the term "support" relates to supporting, pulling out, holding against a spring force or gravity, or to something similar. In particular, supporting can relate to determining a vertical location of the partition. Thus the support element, which directly supports the partition in a given situation, can define the vertical location thereof.

The support element can, in particular, be arranged on the associated worktop in such a way as to be fixedly connected thereto. In this way, the location and/or height of the worktop can determine the vertical location of the associated support element, which in turn can define, in given situations, the vertical location of the partition.

In the context of the invention, the term "partition" can relate to a structure which allows adjacent workstations to be separated or partitioned from one another. It can be used, for example, as—an at least substantially opaque—privacy screen or sound attenuation, as—an at least partially transparent—splash protection, as a design element or for similar purposes. The partition can comprise a rigid panel, such as a sound insulation element, a wooden panel, a panel made from a compacted fibre material or a similar panel. Alternatively or in addition, it can comprise a usually tensioned textile or other flexible material.

Since a support element is provided at each worktop, by means of which the height-adjustable partition can be supported in the vertical direction, this enables a suitable or optimum height and/or a suitable or optimum vertical position of the partition to be set can be achieved, independent of the absolute and relative vertical positions of the first and second worktop. This can also make it possible for the partition to be carried or supported alternately by one or the other support element, depending on the relative height positions of the worktops, such that the vertical position or location of the partition is determined by the respective supporting support element. This enables flexible positioning of the partition, adapted to the respective height setting of the worktops. Thus optimum delimitation or separation of the workstations can be achieved using a single partition.

The furniture composition is preferably designed such that the first support element supports the partition if the first worktop is located above the second worktop, and the second support element supports the partition if the second worktop is located above the first worktop.

In this context, the term "above" relates to situations in which the two worktops have different vertical positions or lie at different heights. The higher worktop is then consequently above the other worktop.

Such arrangement makes it possible for the partition to be supported or carried by the support element of whichever worktop is found at a higher vertical location. Support of the partition by the support element or support elements of whichever worktop is found in a lower vertical position of the two worktops, is not required. In this way, the higher worktop can always determine the vertical location of the partition, which leads to a positioning of the partition adapted to the height location of the worktops relative to each other. Thus the partition can always be automatically adapted to the respective situation.

Preferably, the first support element does not support the partition if the first worktop is located below the second worktop, and the second support element does not support the partition if the second worktop is located below the first worktop.

In this context, the term "below" can relate to situations in which the two worktops have different vertical positions or lie at different heights. The lower worktop is then consequently below the other worktop.

Such a design of the furniture composition makes it possible that the partition is only ever respectively supported by the support element of one of the two worktops. The other support element is detached from the partition. Advantageously, the two support elements are designed such that the partition can be transferred from one support element to the other support element if the two worktops pass each other in the vertical direction. For example, in a first position, the first worktop can be arranged above the second, such that the first support element supports the partition and the second support element does not. On lowering of the first worktop, the partition is lowered therewith, until the first worktop lies at the same height as the second. In the event of further lowering of the first worktop, the partition is transferred from the first support element to the second support element. As soon as the first worktop lies below the second, the partition is supported by the second support element and no longer by the first.

Preferably, the first support element of the first worktop and the second support element of the second worktop are each designed to carry the partition. In many applications, and particularly in the context of many types of partitions, such a carrier can be a simple and efficient form of support. For example, a rigid panel of the partition can be respectively carried by one of the support elements. For this purpose, the support element can for example grip the panel from underneath. Alternatively, as described in more detail below, the support elements can carry an element of a partition, by means of which a cover can be held or removed.

In this case, the first support element of the first worktop and the second support element of the second worktop preferably each comprise an upwardly-open shell that is designed to receive the partition. Such a shell can enable stable support of the partition in a simple manner. In addition, the shell can enable efficient and simple transfer of the partition between the two support elements. The shell can be, in particular, a half shell, the inside of which is matched to the shape of the outside of the part of the partition on which the shell supports the partition. For example, the shell can have the shape of a hollow half cylinder, if the partition comprises a round rod or other cylindrical part.

In a preferred embodiment of the furniture composition, the first support element of the first worktop is designed to raise the partition if the first worktop is adjusted, for example, from a position below the second worktop into a position above the second worktop. The second support element of the second worktop is then designed to raise the partition, if the second worktop is adjusted for example from a position below the first worktop into a position above the first worktop.

In this way it can be achieved that a height setting of the partition during an adjustment of one or both worktops automatically matches the position of the worktops in the vertical direction. This enables convenient and efficient setting of the partition according to the height setting of the worktops.

In a preferred embodiment, the partition is designed as a partition that can be pulled out, wherein it can be at least partially sunk into a stowage space which is provided under the first and/or second worktop. In this case, at least one grip element is preferably provided on the partition, by means of which the partition can be pulled vertically out of the stowage space, and each of the first and second support elements can engage with at least one of the at least one gripping elements, in order to pull the partition out of the stowage space in the event of a height adjustment of the associated worktop in the vertical direction.

The embodiment of the partition as a partition that can be pulled out and can be at least partially sunk into a stowage space, enables the partition, in situations in which the presence of a partition is not desired, to be removed and stowed away in an uncomplicated manner. In addition, a vertical dimension of the partition or a part thereof can be adapted so that it also extends, in particular, into a vertical region between a high and a low vertical position of the two worktops and does so independently of the absolute and relative vertical positions of the first and second worktop.

Here, the stowage space can be produced as a volume that is either open or at least partially enclosed from a plurality of sides, which comprises at least one opening through which the partition can be pulled out. An extension of the stowage space in the vertical direction is also preferably delimited in a region underneath a lowest position of the worktops. In this way, the stowage space can be provided in a safe and problem-free manner in the furniture composition.

The first support element is preferably arranged in such a way on the first worktop that it engages with at least one of the at least one grip elements, in order to pull out the partition from the stowage space in the vertical direction, if the first worktop is adjusted from below to above the second worktop, and the second support element is preferably arranged in such a way on the second worktop that it engages with at least one of the at least one gripping elements, in order to pull the partition out of the stowage space in the vertical direction, if the second worktop is adjusted from below to above the first worktop. In this way, an efficient transfer of the partition in the above described manner can be implemented using the partition that can be pulled out.

The furniture composition preferably comprises a common support frame and/or in particular a table frame, on which the two worktops are mounted, independently adjustable in the vertical direction. Such a support frame can enable efficient production and handling of the furniture composition. The stowage volume for a partition that can be pulled out, can also be integrated in an efficient manner into or with the common support frame. Alternatively, a separate support frame can also be provided for each of the worktops, wherein the two support frames can preferably be detachably secured to one another.

In a preferred embodiment of the furniture composition according to the invention, the partition is designed in such a way that it extends in the vertical direction into a region above the higher of the two worktops, and in particular projects by at least 30 cm or projects by at least 50 cm above the height of the two worktops. Consequently, a sound insulation or privacy screen can be provided in a region in which this is particularly desirable. In particular, this region can cover the upper body and the head of a person active at the workstation.

For partitions using rigid panels, such an elevation can be achieved by a suitable dimension of the panel. For example, a grip element can be arranged below an upper edge of the partition, in particular at a vertical separation of at least 30 cm, preferably at least 50 cm. Alternatively, a grip element can also be formed or provided at a lower edge of the partition, wherein said grip element can be integrated in particular in the partition or can form an integral component of the partition.

In a preferred embodiment, the furniture composition preferably comprises a rigid elevation element, which can be detachably connected to the first support element and the partition, or to the second support element and the partition, in such a way that the partition ends above the first worktop if the first support element supports the partition by means of the elevation element, and such that the partition ends above the second worktop if the second support element supports the partition by means of the elevation element. Thus the elevation element can in particular be substantially elongate, for example in the shape of an elevation arm. By means of the elevation element, it is possible to secure or support the upper edge of the partition in a vertical position above the corresponding worktop. The elevation element can then act, so to speak, as a vertical extension of the respective support element, which supports the partition. Since the elevation element is detachably connectable to the partition and the support elements, it can optionally be applied or removed. In this way, depending on the situation, the partition can end on the associated worktop or be pulled upward out of same. The term "connectable" relates in this context in particular to a connection which is sufficient for stabilising for holding the partition by means of the first or second support element. Thus the connection to the partition can be produced for example by plugging, clamping-on or the like and the connection to the support elements can be produced by abutting, clamping or the like.

The elevation element preferably extends substantially in the vertical direction, wherein in a region of a lower end of the elevation element, an alternative grip element is formed or provided, which can alternately engage with the first support element or the second support element in order to support the partition in the vertical direction. Such an embodiment of the elevation element, comprising an alternative grip element, enables an efficient transfer of the elevation element and the partition connected thereto, from one support element onto the other support element. In particular, such a transfer as described above can take place if one worktop is raised vertically past the other worktop. In this way, it can be ensured that the partition always ends above the respectively higher of the two worktops and thus protection is available adapted to every situation. For example, the partition can end at least approximately 30 cm or at least approximately 50 cm above the upper worktop. In this way, the elevation element can have a corresponding vertical extension of approximately at least 30 cm or at least approximately 50 cm.

Advantageously, the elevation element can be designed with a connection element, by means of which it is connectable to the respective support element. The connection element can be formed as a receptacle for a grip element provided on the partition. This enables the partition to be used optionally with or without an elevation element, and thus to adapt to an actual work situation.

In a preferred embodiment of the furniture composition, the partition comprises a roller blind with a part that can be pulled out and/or unrolled and in particular a material web that can be pulled out and/or unrolled. The roller blind can comprise a roller blind casing that is mounted in a region below the first and/or second worktop, typically provided or mounted in a stowage space. The stowage space can in particular be formed by a roller blind casing. When not in use, the part that can be pulled out or unrolled can be pulled back or pushed back into the region below the first and/or second worktop and/or rolled up there or similar. In particular, the material web can be rolled up in a spring-loaded manner in the roller blind casing, so that it must be pulled out of the roller blind casing against the spring force. In this way, the material web can always be rolled up to an adapted degree and the remaining part of the material web is supplied cleanly in the roller blind casing.

The part of the roller blind that can be pulled out or unrolled preferably comprises a web made from material that is flexible at least in sections, in particular from a fabric and/or a film, which can be attached at a first end to a rotatably mounted axle or shaft and by rotating the axle can be at least partially rolled up on itself. A clamping strip is preferably attached to the web at a second end opposite the first end, which forms an outer longitudinal end of the part that can be pulled out or unrolled. The web or material web can be unrolled from the axle or shaft by pulling, in particular at the clamping strip. The axle or shaft is preferably mounted in a housing provided with an opening through which the web can be fed out from said housing. The axle or shaft is preferably tensioned for example by means of a spring, such that the web is rolled up on the axle or shaft without further action when no pull is applied to the clamping strip, wherein the web can be at least partially stowed in the housing.

The term "roller blind" can relate in this context to a device, by means of which the material web or web is wound on to an axle or shaft. The shaft is typically arranged in a roller blind casing and acted on by a rotational spring. The material web can be pulled out of the roller blind casing as needed, wherein a certain amount of tension must be maintained throughout against the action of the rotation spring, so that the material web does not roll up again. In this way, the roller blind can ensure that only so large a portion of the material web as is currently required is unrolled.

Alternatively, the roller blind can be realised as a pleated blind, comprising a web made from a material that is flexible at least in sections, in particular from a fabric and/or a film, and able to be pulled out or unrolled, which forms the partition in a pulled-out position, and which can be folded back on itself section-by-section in order to retract the pleated blind.

Similarly the roller blind can alternatively be realised as a sliding blind and the part that can be pulled out or unrolled comprises in particular a plurality of lamellae which can be pulled apart when the sliding blind is pulled out, and pushed together again when the roller blind is pulled in.

Due to the fact that the partition is formed from a part of a roller blind that can be pulled out or rolled up, in situations in which the presence of a partition is not required, it can be removed and stowed in an uncomplicated manner. With such a roller blind, the partition can also be dimensioned efficiently and easily adapted to the height positions of the worktops.

The roller blind preferably comprises a clamping strip on an outer longitudinal end of the part that can be pulled out and/or unrolled, which projects in the lateral direction beyond a width of the part that can be pulled out and/or unrolled, wherein each of the two longitudinal ends of the clamping strip which project beyond the part that can be pulled out and/or unrolled, forms a respective grip element. The grip elements can be simply and functionally implemented in this way.

The grip element formed or provided on the elevation element and the at least one support element provided on the first worktop and the at least one second support element provided on the second worktop can be formed in such a way that the grip element can alternatively engage in a form-fit manner with the support element provided on the first worktop and with at least the support element provided on the second worktop, wherein the elevation element is preferably held or at least supported in a vertical orientation by means of the form fit. In this way, a vertical orientation of the partition is stabilised or prescribed, which is then particularly advantageous if the partition is formed from a part of a roller blind that can be pulled out or unrolled.

In another embodiment of the furniture composition, the partition comprises an at least substantially rigid, flat element formed in particular from a board or a panel made from wood, plastic, a composite material or similar. It is also conceivable to form the partition from glass or acrylic glass. A frame covered with a film or fabric can also be used. The use of an at least substantially rigid, flat element for the partition enables a particularly simple and cost-effective production and represents a particularly fault-resistant construction.

The at least one grip element of the partition is preferably alternately either connected to the first support element of the first worktop or to the second support element of the second worktop.

The partition is preferably opaque. In this way a frequently desired privacy screen is provided, for example, above and below the worktops.

The furniture composition is preferably designed such that the partition is supported, depending on the relative vertical location of the first worktop and of the second worktop, alternately by the first support element or by the second support element, so that the vertical location of the partition is determined by the respective supporting support element. In other words or in an alternative wording, the partition can preferably be automatically transferred between the first support element and the second support element during changes in height of the first or second worktop, such that it is supported in each case by the support element of the higher worktop. The worktop itself is always supported by the higher tabletop and can deploy its effect from the upper relevant position.

Another aspect of the invention relates in particular to a retrofit partition for a furniture composition comprising a first workstation which comprises a first worktop adjustable in a vertical direction, and a second workstation which has a second worktop that is adjustable, independently from the first worktop, in the vertical direction. The partition comprises a roller blind with a part that can be pulled out and/or unrolled, in particular a material web that can be pulled out and preferably a fabric web, for partitioning the first workstation from the second workstation, wherein the roller blind preferably comprises a clamping strip projecting laterally beyond a width of the material web, and at least two support elements for attaching each thereof to one of the first and second worktops of the furniture composition, wherein by means of the support elements the material web of the roller blind can be pulled out during a height adjustment of one of the worktops.

Using such a partition, a furniture composition can be efficiently retrofitted. This enables the partition to be equipped with the features described above in the context of the furniture composition according to the invention. Thus the above-mentioned effects and advantages can be efficiently implemented.

In an analogous embodiment, such a partition can also be provided, or be, on an individual workstation with an individually height-adjustable worktop. This can act, for example, as a privacy screen or to prevent the entry of objects or similar into a height-adjusted area or a region underneath the individual worktop. In particular, the shaft or axle of the roller blind and/or a housing of the roller blind is mounted on or attached to a support frame for the individual worktop, in particular a table frame, or on the floor in a region underneath the individual worktop. The part that can be pulled out can, in analogy to the embodiments described above and below or the subsequently described designs, be supported or carried by at least one support element mounted or attached on the individual worktop.

Alternatively, the shaft or axle of the roller blind and/or a housing of the roller blind can be supported or carried by the shaft or axle of at least one support element mounted or attached on the individual worktop, and the outer longitudinal end of the part of the roller blind that can be pulled out or the material web can be mounted or attached on the support frame for the individual worktop or also on the floor in a region underneath the individual worktop.

Another aspect of the invention therefore relates to a workstation or individual workstation having a foot section, an adjustable worktop that can be adjusted in the vertical direction with respect to the foot section and a height-adjustable partition, wherein the partition comprises a roller blind having a base unit and a material web that can be pulled out of the base unit, wherein either an end of the material web facing away from the base unit is preferably detachably connected with the worktop and the base unit is attached in a fixed manner to the foot part, or the base unit is preferably detachably connected to the worktop and the end of the material web facing away from the base unit is attached in a fixed manner to the foot section.

The base unit of the roller blind can comprise a housing and in particular a shaft. The material web can be rolled up or be able to be rolled up on the shaft. Further, the base unit can comprise a tension structure such as a spring for example, by means of which the material web is rolled up on the shaft.

The end of the material web facing away from the base unit, or the base unit per se, can be detachably fastened at a corner of the worktop. They can also be raised above the worktop, for example by means of an elevation element connected to the worktop. The fixed connection to the foot section can be formed for example by means of a direct fixed mounting on the foot section or by a support frame extending therefrom. Alternatively said connection can be made by means of the floor on which the foot section is positioned.

With such a workstation, it is possible that an extension of the partition in the vertical direction is achieved in the event of a height adjustment of the worktop without further action. In particular, the material web can always be pulled out of the base unit to an extent corresponding to the current height setting of the workshop.

In connection with the above-described workstation or individual workstation, further aspects of the invention can be realised, as described above or below in combination with the furniture composition according to the invention and the partition according to the invention. In particular, the workstation or individual workstation can be equipped with further features of the furniture composition, in order to thus produce the corresponding effects and advantages.

BRIEF DESCRIPTION OF THE DRAWINGS

Further advantageous embodiments of the invention result from the following description of exemplary embodiments of the invention with the help of the schematic drawing. In particular, in the following, the furniture composition according to the invention is described in detail with reference to the attached drawings on the basis of exemplary embodiments.

WAYS TO EXECUTE THE INVENTION

Figure 1:
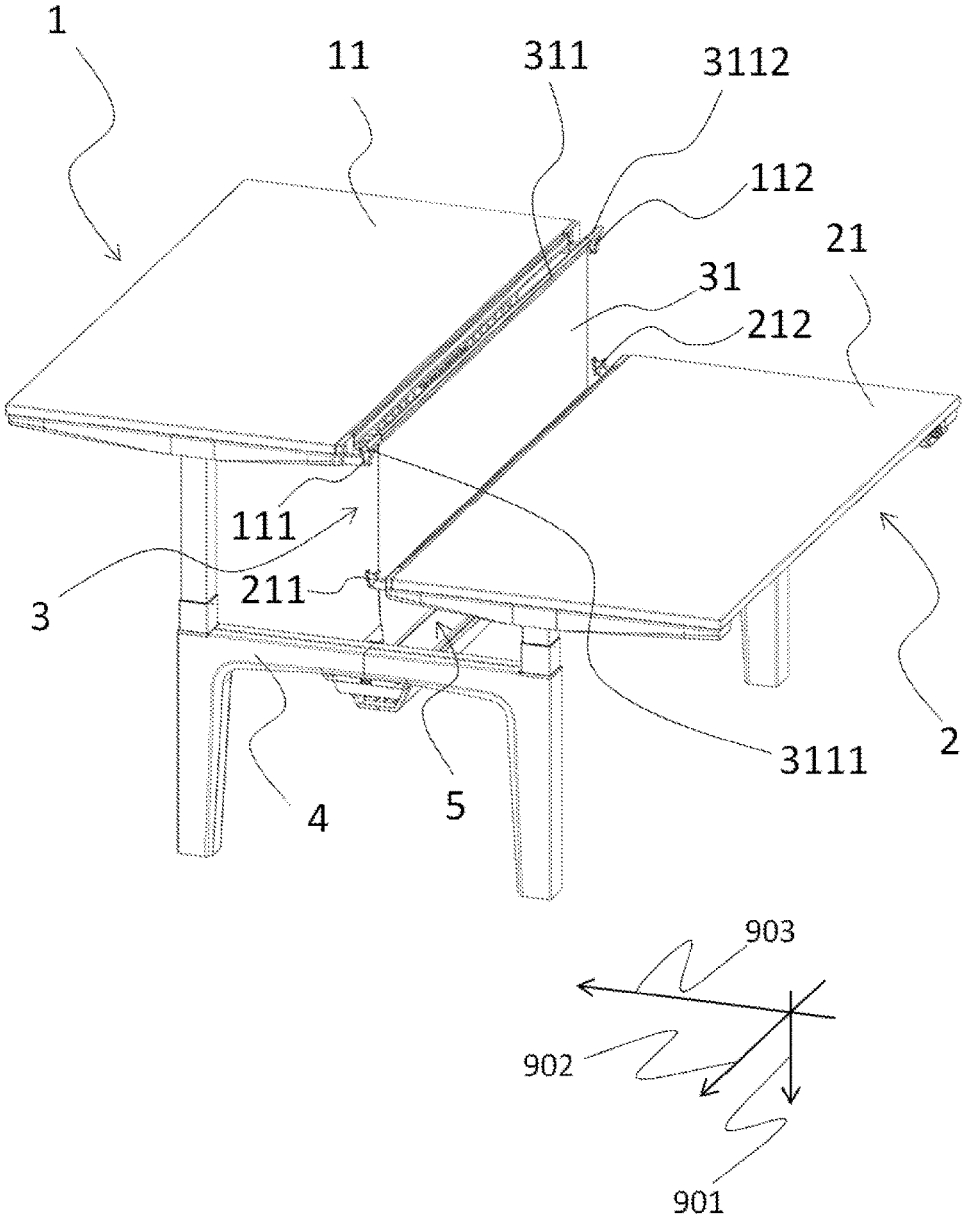
FIG. 1 shows a preferred exemplary embodiment of a furniture composition according to the invention, in a schematic representation.

Certain expressions are used in the following description for practical reasons and should not be understood to be limiting. The words "right", "left", "top" and "bottom" designate directions in the drawing to which reference is being made. The expressions "inwards", "outwards", "under", "above", "left", "right" or similar are used to describe the relative arrangement, of the referenced parts, the relative movement of referenced parts and the directions towards and away from the geometric centre of the invention, and named parts thereof as illustrated in the figures. These relative spatial data also comprise other positions and orientations than those shown in the figures. For example, if a part illustrated in the figure is turned upside down, the elements or features which are described as "at the bottom", are then "at the top". The terminology includes the words specifically mentioned above, derivatives thereof and words with similar meaning.

In order to avoid repetitions in the figures and the corresponding description of the different aspects and exemplary embodiments, certain features should be understood as common for different aspects and exemplary embodiments. The omission of an aspect in the description or a figure does not imply that this aspect is lacking in the associated exemplary embodiment. Rather, such an omission can be used to improve clarity and avoid repetition. In this context, the following definition applies to the entire remainder of the description: If reference signs are used in a figure for the purposes of drawing clarity, but are not mentioned in the directly associated description text, reference is made to the explanation of said reference signs in the preceding descriptions of the figures. If, in addition, reference signs are mentioned in the description text belonging directly to a figure, which reference signs are not contained in the figure, then reference is made to the preceding or subsequent figures. Similar reference signs in two or more figures represent similar or identical elements.

Figure 2:
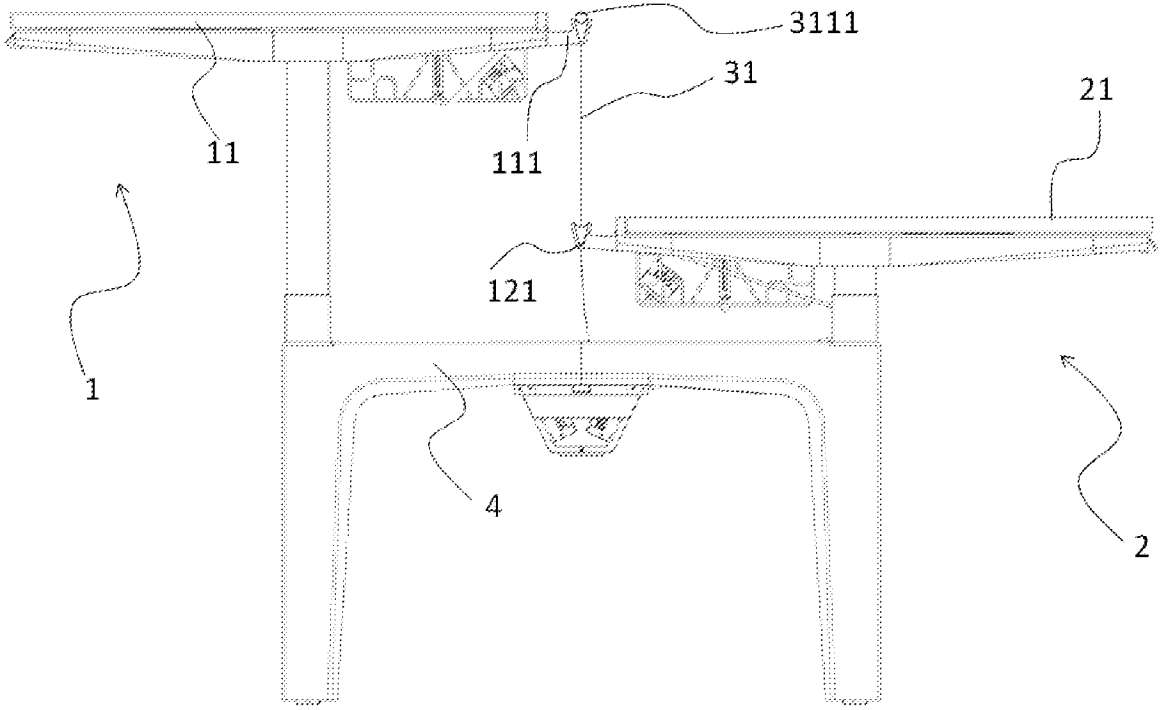
FIG. 2 shows a side view of the furniture composition from FIG. 1.

FIG. 1 shows an exemplary embodiment of a furniture composition according to the invention in a schematic representation. FIG. 2 shows a side view of the furniture composition from FIG. 1.

The furniture composition comprises a first workstation 1 and a second workstation 2. A partition 3 is provided between these, which runs in a vertical direction 901 and extends in a first horizontal direction 902 orthogonal to the vertical direction 901 over approximately the entire width of the first and second workstations 1, 2. On a common table frame 4, which serves as a common support frame, a first worktop 11 belonging to the first workstation 1, and a second worktop 21 belonging to the second workstation 2, are independently adjustable with respect to a vertical direction 901 or height-adjustable. The table frame 4 comprises telescopic legs, which can be extended and pushed together in the vertical direction.

The partition 3 comprises a roller blind having a fabric web 31 that can be pulled out vertically. The fabric web 31 represents a part of the roller blind that can be pulled out or unrolled. The roller blind further comprises a housing or a roller blind casing 5, in which the fabric web 31 is wound on a shaft. The shaft is connected to a rotation spring, which rotates the shaft in such a way that the fabric web is rolled up if it is not being actively pulled. The roller blind casing 5 is mounted on the table frame 4 underneath the first and second worktops 11, 21 and forms a stowage space of the furniture composition. Thus the stowage space is also provided in a region underneath the two worktops 11, 12. As indicated, the fabric web 31 is rolled up or can be rolled up on the rotatably mounted axle of the roller blind in the roller blind casing 5, wherein the axle runs in the first horizontal direction 902 and is tensioned by a spring, so that the fabric web 31 can be rolled up automatically. The stowage space is sized and arranged so that it has sufficient space if the fabric web is completely rolled up. However, it is limited to a region underneath a lowest settable position of the two worktops 11, 12. A clamping strip 311 is attached at an end of the fabric web 31 that faces away from the roller blind casing. The length of the clamping strip 311 is therefore greater than the width of the fabric web 31, such that the clamping strip 311 projects laterally beyond the fabric web 31 on both sides, i.e. in the first horizontal direction 902.

The ends of the clamping strip 311 projecting laterally in this way beyond the fabric web 31 thus form a first grip element 3111 and a second grip element 3112 of the roller blind or partition 3.

A first support element comprising a first shell 111 and a second shell 112 is provided on the first worktop 11 in the region of a rear edge facing the second worktop 12, which is so positioned with respect to the first horizontal direction 902 that it engages with the first and second grip element 3111, 3112 of the clamping strip 311.

Similarly, a second support element comprising a first shell 211 and a second shell 212 is provided on the second worktop 12 in the region of a rear edge facing the first worktop 11, which is positioned in such a way with respect to the first horizontal direction 902 that it engages with the first and second grip element 3111, 3112 of the clamping strip 311.

The first shell 111 of the first support element and the first shell 211 of the second support element are adjacent and positioned offset from one another with respect to the first horizontal direction 902. Similarly, the second shell 112 of the first support element and the second shell 212 of the second support element are adjacent and positioned offset from one another with respect to the first horizontal direction 902.

If the fabric web 31 is completely rolled up in the roller blind casing 5, it can be pulled out by pulling on the first and second grip element 3111, 3112 of the clamping strip 311 against the spring force and thus at least partially unrolled from the axle. If the first worktop 11 and the second worktop 21 are located in different vertical positions or at different heights, the first grip element 3111 and the second grip element 3112 of the clamping strip can be applied on the shells 111, 112, 211, 212 of the support element of the upper of the two worktops, once the fabric web 31 has been sufficiently unrolled. If, as can be seen as an example in FIG. 1 and FIG. 2, the first worktop 11 is located above the second worktop 21, the first grip element 3111 and the second grip element 3112 can be applied on the first shell 111 or the second shell 112 of the first support element. In this way, the first and second shells 111, 112 of the first support element carry the partition 3 or support same vertically. The fabric web 31 is thus vertically clamped between the clamping strip held by the first support element 311 and the roller blind casing. This partitions the first workstation 1 from the second workstation.

If, starting from the position shown in FIG. 1 and FIG. 2, the first worktop 11 is now adjusted upwards or counter to the vertical direction 901, then the fabric web 31 is pulled further out of the roller blind casing 5 by the first support element at the clamping strip 311, such that a vertical dimension of the partition matches a new height of the first worktop 11.

If, starting from the position illustrated in FIG. 1 and FIG. 2, the first worktop 11 is by contrast adjusted downwards, the fabric web 31 is rolled up on the axle due to the spring-loaded tension thereof, so that the vertical dimension of the partition is again adapted to the new height of the first worktop 11, for as long as the first worktop 11 remains in a vertical position above the second worktop 21.

If the first worktop 11 drops again below the second worktop 21, the first and second shells 211, 212 of the second support element engage with the first grip element 3111 or the second grip element 3112 and prevent further rolling up of the fabric web 31. In this event, the partition 3 formed by the fabric web 31 is no longer supported in the vertical direction by the first support element of the first worktop 11, but rather by the second support element of the second worktop 21.

In a similar manner, the first shell 211 and the second shell 212 of the second support element engage with the first grip element 3111 or the second grip element 3112, if—starting from the position shown in FIG. 1 and FIG. 2—the second worktop 12 is raised upward into a vertical position above the first worktop 21. Thus the fabric web 31 is pulled further out from the stowage space 5. In this case also, the fabric web 31 or the clamping strip 311 is no longer supported in the vertical direction by the first support element.

Figure 3:
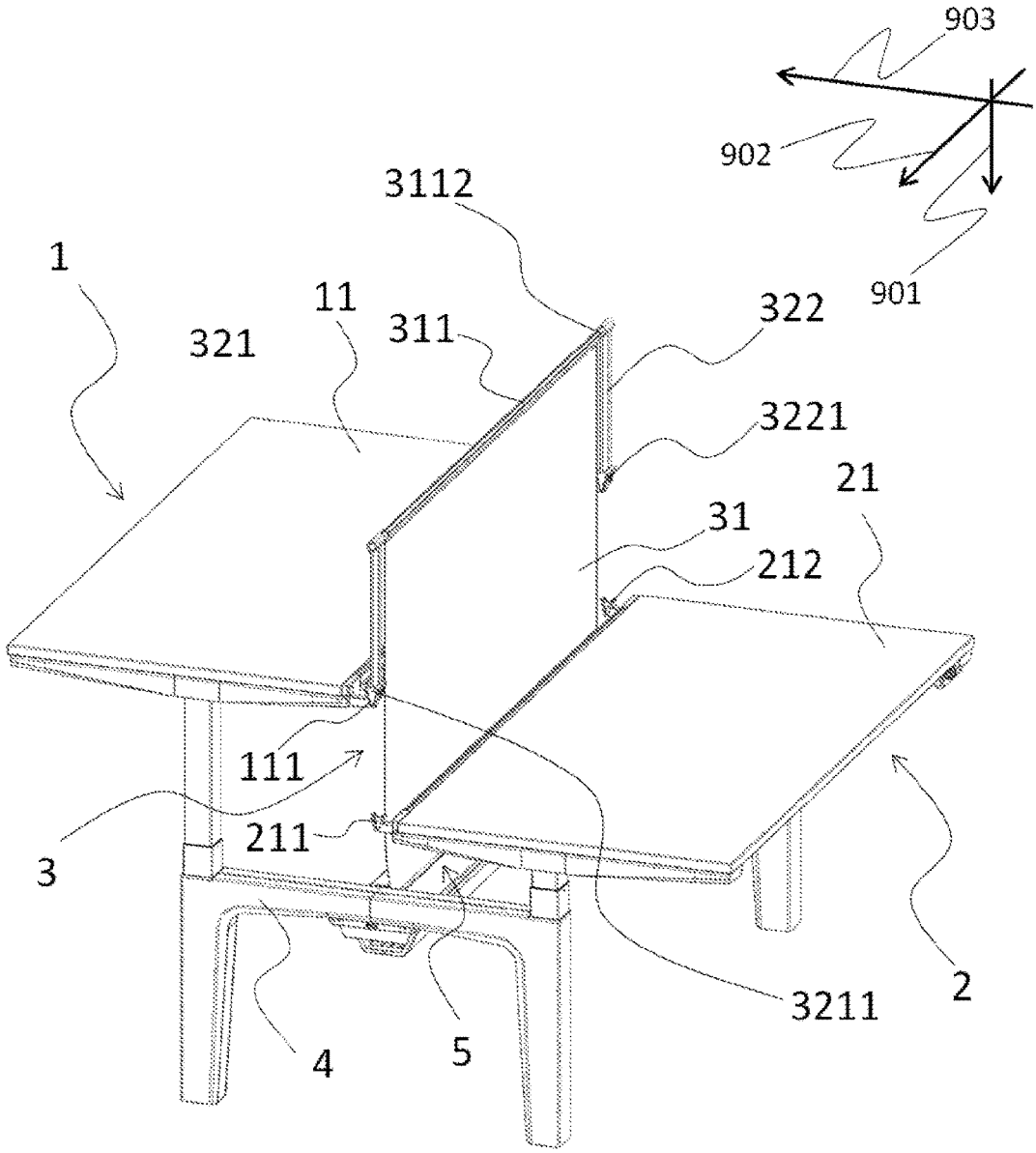
FIG. 3 shows a schematic representation of the furniture composition according to the invention from FIG. 1 in a modified configuration.
Figure 4:
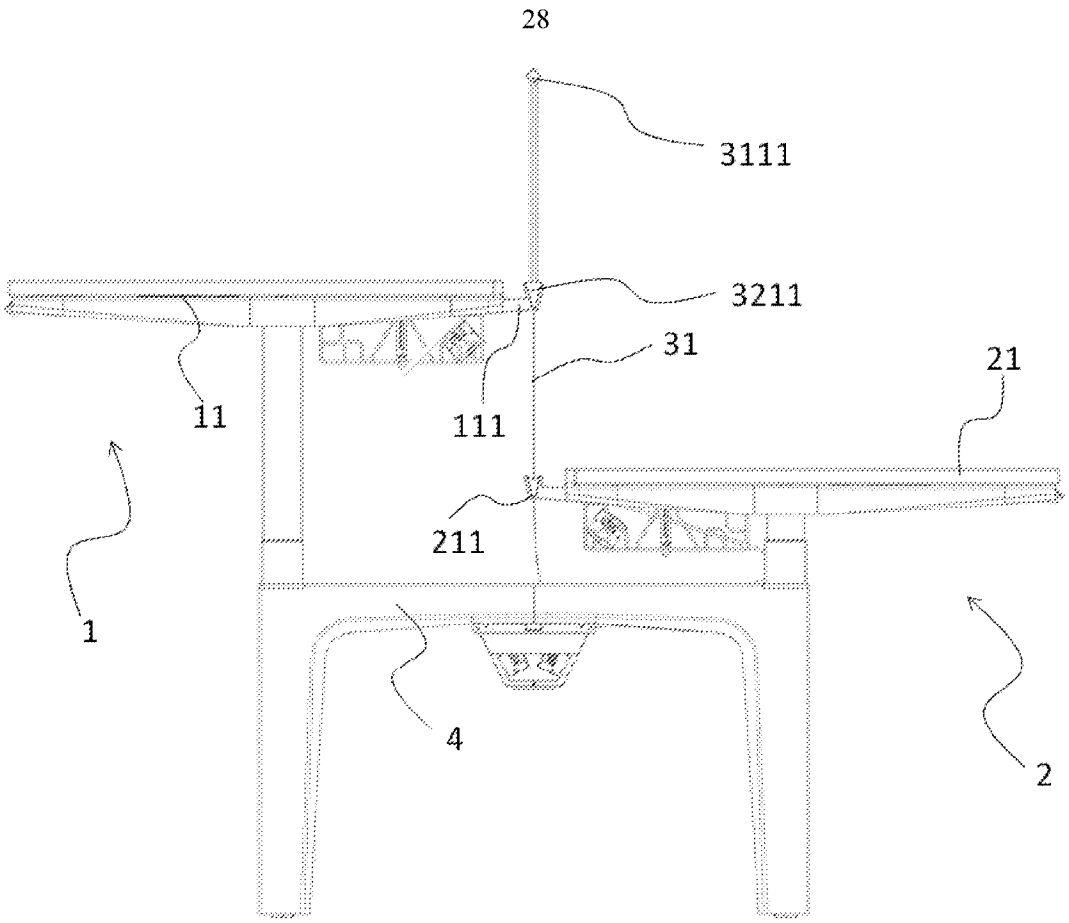
FIG. 4 shows a side view of the furniture composition from FIG. 3.
Figure 5:
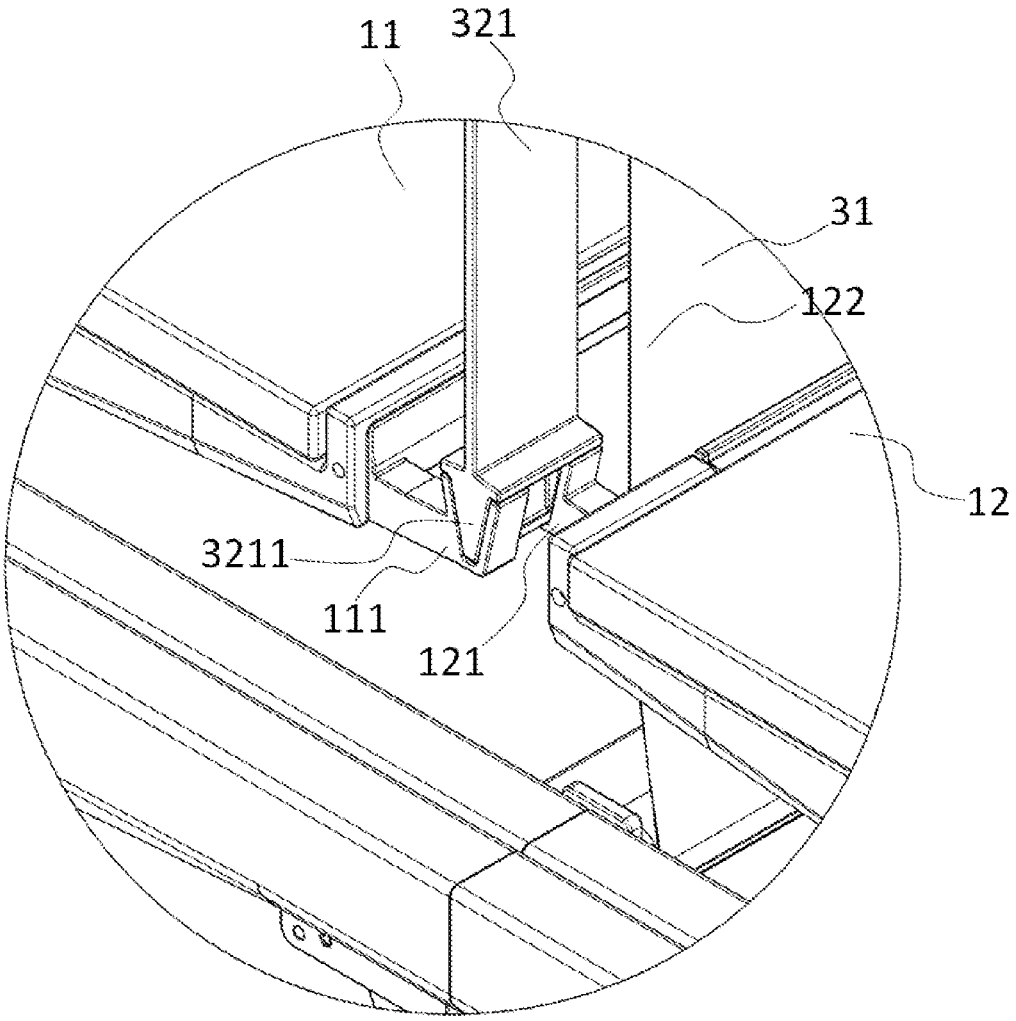
FIG. 5 shows a detailed view of FIG. 3.

FIG. 3 schematically shows the furniture composition from FIG. 1 in a modified configuration. FIG. 4 shows a side view of the furniture composition from FIG. 3. FIG. 5 is a detailed view of FIG. 3.

In the altered configuration from FIGS. 3 to 5, the first raising arm 321 is provided as a first elevation element 321 and a second elevation arm 322 is provided as the second elevation element. Both elevation arms 321, 322 are designed to fix an upper edge of the fabric web 31 of the partition 3 in a vertical position above the respective worktop 11, 21, which finds itself in a higher position. In FIG. 3, this is the left-hand side first worktop 11. The two elevation arms 321, 322 are thus designed at least substantially identical and comprise an at least substantially oblong or elongate shape, and extend vertically. A cylindrical drilled hole is provided in the region of a first end of one of each of the elevation arms 321, 322 which is dimensioned such that the elevation arm 321, 322 on which the grip elements 3111 or 3112 are formed by the ends of the clamping strip 311 projecting laterally beyond the fabric web 31, can be inserted.

A second end of the first elevation arm 321 is formed as a first alternative grip element 3211, and a second end of the second elevation arm 322 is formed as a second alternative grip element 3221. As shown in detail in FIG. 5, the alternative grip elements 3211, 3221 are at least substantially V-shaped or have a V-shaped cross section in the vertical direction 901. The shells 111, 112, 211, 212 of the first and second support elements are formed correspondingly V-shaped. Thus the shells 111, 112, 211, 212 engage in a form-fit manner with the elevation elements 321, 322, wherein the elevation elements 321, 322 are fixed in such a way that they extend in the vertical direction and are secured against tilting from the vertical position.

As can be clearly seen from FIG. 5, the first shell 111 of the first support element and the first shell 211 of the second support element are spaced apart adjacent to each other. When the first and second worktops 11, 12 pass each other in the vertical direction, the two shells 111, 211 can thus be easily guided past one another. At the same time, it can be ensured that the upper shell 111, 211 always carries the partition on the first grip element 3111 or if appropriate on the first alternative grip element 3211.

Although the invention is illustrated by means of the figures and the associated description and described in detail, said illustration and said detailed description should be understood as illustrative and exemplary and not as limiting the invention. In order not to mystify the invention, in certain cases well-known structures and techniques are not shown and described in detail. It is understood that person skilled in the art can make changes and modifications, without going beyond the scope of the following claims. In particular, the present invention covers further exemplary embodiments with a composition of the features which may deviate from the explicitly described combination of features.

The present disclosure also includes embodiments having any combination of features that are stated or shown above or below for various embodiments. It likewise includes individual features shown in the figures, even if they are shown in combination with other features and/or are not mentioned before or after. The alternatives of embodiments described in the figures in the description, as well as individual alternatives of the features thereof, may be excluded from the subject matter of the invention or from the disclosed subject matter. The disclosure includes embodiments which exclusively comprise features that are exclusively described in the claims or in the exemplary embodiments, as well as those which comprise other additional features.

In addition, the term "comprise" and derivatives thereof do not exclude other elements or steps. Likewise, the indefinite article "a" or "an" and derivatives thereof do not exclude a plurality. The functions of multiple features listed in the claims can be fulfilled by an entity or by a step. The terms "substantially, "approximately", "about" and similar, in connection with a property or a value, also define exactly the property or exactly the value. The terms "approximately" and "about" in combination with a given numerical value or—range can relate to a value or range which lies within 20%, within 10%, within 5% or within 2% of the given value or range. Any reference sign in the claims should not be seen as limiting the scope of the claims.

The invention claimed is:

1. A furniture composition, comprising:

a first workstation having a first worktop adjustable in a vertical direction;

a second workstation having a second worktop adjustable in the vertical direction independently of the first worktop;

a partition that is height-adjustable and includes at least one grip element, the partition extending in the vertical direction between the first workstation and the second workstation;

a first support element provided on the first worktop and configured to engage the at least one grip element to support the partition when the first worktop is located above the second worktop; and a second support element provided on the second worktop and configured to engage the at least one grip element to support the partition when the second worktop is located above the first worktop.

2. The furniture composition according to claim 1, wherein the first support element is configured to disengage from the at least one grip element of the partition when the first worktop is located below the second worktop, and the second support element is configured to disengage from the at least one grip element of the partition when the second worktop is located below the first worktop.

3. The furniture composition according to claim 2, wherein the first support element of the first worktop is configured to engage the at least one grip element to raise the partition when the first worktop is adjusted into a position above the second worktop, and the second support element of the first worktop is configured to engage the at least one grip element to raise the partition when the second worktop is adjusted into a position above the first worktop.

4. The furniture composition according to claim 1, wherein the first support element of the first worktop and the second support element of the second worktop are each designed to carry the partition.

5. The furniture composition according to claim 4, wherein the first support element of the first worktop is configured to engage the at least one grip element to raise the partition when the first worktop is adjusted into a position above the second worktop, and the second support element of the first worktop is configured to engage the at least one grip element to raise the partition when the second worktop is adjusted into a position above the first worktop.

6. The furniture composition according to claim 4, wherein the first support element of the first worktop and the second support element of the second worktop each comprise an upwardly-open shell that is designed to receive the partition.

7. The furniture composition according to claim 6, wherein the first support element of the first worktop is configured to engage the at least one grip element to raise the partition when the first worktop is adjusted into a position above the second worktop, and the second support element of the first worktop is configured to engage the at least one grip element to raise the partition when the second worktop is adjusted into a position above the first worktop.

8. The furniture composition according to claim 1, wherein the first support element of the first worktop is configured to engage the at least one grip element to raise the partition when the first worktop is adjusted into a position above the second worktop, and the second support element of the first worktop is configured to engage the at least one grip element to raise the partition, when the second worktop is adjusted into a position above the first worktop.

9. The furniture composition according to claim 1, wherein the partition can be pulled out, wherein the partition is at least partially retractable into a stowage space provided under the first worktop and/or the second worktop, the at least one grip element provided on the partition is configured to provide means by which the partition can be pulled out from the stowage space in the vertical direction, and each of the first support element and the second support element are configured to engage with at least one of the at least one grip element, in order to pull out the partition from the stowage space in the vertical direction, in the event of a height adjustment of the associated worktop.

10. The furniture composition according to claim 9, wherein the at least one grip element includes a first grip element and a second grip element, each of the first grip element and the second grip element projecting laterally beyond the partition from opposing sides, the first support element is arranged at a rear region of the first worktop and is configured to engage the first grip element of the partition and the second grip element of the partition to pull out the partition in the vertical direction from the stowage space, when the first worktop is adjusted from below to above the second worktop, and the second support element is arranged at a rear region of the second worktop and is configured to engage the first grip element of the partition and the second grip element of the partition to pull out the partition in the vertical direction from the stowage space, when the second worktop is adjusted from below to above the first worktop.

11. The furniture composition according to claim 9, wherein the partition comprises a roller blind having a part that can be pulled out and/or unrolled.

12. The furniture composition according to claim 11, wherein the roller blind comprises a clamping strip on an outer longitudinal end of the part that can be pulled out and/or unrolled, which projects in the lateral direction beyond a width of the part that can be pulled out and/or unrolled, wherein each of two longitudinal ends of the clamping strip which project beyond the part that can be pulled out and/or unrolled forms a respective grip element.

13. The furniture composition according to claim 9, further comprising a rigid elevation element configured for detachable connection to and vertical extension between either the first support element and the at least one grip element of the partition or the second support element and the at least one grip element of the partition, such that a first end of the rigid elevation element engages with the first support element or the second support element and a second end of the rigid elevation element engages with the at least one grip element of the partition such that the partition ends above the first worktop when the first support element supports the partition by means of the elevation element, and such that the partition ends above the second worktop when the second support element supports the partition by means of the elevation element.

14. The furniture composition according to claim 13, wherein the elevation element extends substantially in the vertical direction, wherein in a region of a lower end of the elevation element an alternative grip element is formed or provided, which can alternately engage with the first support element or the second support element in order to support the partition in the vertical direction.

15. The furniture composition according to claim 9, wherein the at least one grip element of the partition is alternately either connected to the first support element of the first worktop or to the second support element of the second worktop.

16. The furniture composition according to claim 1, wherein when the first support element engages the at least one grip element to support the partition when the first worktop is located above the second worktop than a vertical location of the partition is determined by the first support element, and when the second support element engages the at least one grip element to support the partition when the second worktop is located above the first worktop than the vertical location of the partition is determined by the second support element.

17. A partition for a furniture composition including a first workstation, which has a first worktop adjustable in a vertical direction, and a second workstation, which has a second worktop adjustable, independently from the first worktop, in the vertical direction, the partition comprising:

a roller blind comprising a material web that can be pulled out in order to partition the first workstation from the second workstation, wherein the roller blind comprises a clamping strip which laterally projects beyond a width of the material web; and at least two support elements for attaching to one of the first worktop and the second worktop of the furniture composition, wherein by means of the at least two support elements the material web of the roller blind can be pulled out in the event of a height adjustment of one of the first worktop and the second worktop, wherein a first one of the at least two support elements is configured for attachment to the first worktop to engage the clamping strip and support the partition when the first worktop is located above the second worktop, and a second one of the at least two support elements is configured for attachment to the second worktop to engage the clamping strip and support the partition when the second worktop is located above the first worktop.

18. The furniture composition according to claim 1, wherein the first support element includes a first shell and a second shell arranged at a rear region of the first worktop, the second support element includes a first shell and a second shell arranged at a rear region of the second worktop, the first shell of the first support element and the first shell of the second support element are positioned offset from one another in a horizontal direction, and the second shell of the first support element and the second shell of the second support element are positioned offset from one another in the horizontal direction.

* * * * *